US011187037B2

(12) United States Patent
Rafii

(10) Patent No.: US 11,187,037 B2
(45) Date of Patent: Nov. 30, 2021

(54) COLLAPSIBLE LADDER

(71) Applicant: Eddie Rafii, Laguna Niguel, CA (US)

(72) Inventor: Eddie Rafii, Laguna Niguel, CA (US)

( * ) Notice: Subject to any disclaimer, the term of this patent is extended or adjusted under 35 U.S.C. 154(b) by 0 days.

(21) Appl. No.: 16/716,351

(22) Filed: Dec. 16, 2019

(65) Prior Publication Data

US 2020/0263495 A1 Aug. 20, 2020

Related U.S. Application Data

(60) Provisional application No. 62/807,759, filed on Feb. 20, 2019.

(51) Int. Cl.

| | |
|---|---|
| ***E06C 1/383*** | (2006.01) |
| ***E06C 7/08*** | (2006.01) |
| ***E06C 1/20*** | (2006.01) |

(52) U.S. Cl.

CPC ..... *E06C 1/3835* (2013.01); *E06C 1/20* (2013.01); *E06C 7/08* (2013.01)

(58) Field of Classification Search

CPC . E06C 1/3835; E06C 1/18; E06C 1/20; E06C 7/08

See application file for complete search history.

(56) References Cited

U.S. PATENT DOCUMENTS 610,284 A * 9/1898 Schubert ..... E06C 1/20 182/162
772,447 A * 10/1904 Wheelwright ..... E06C 1/20 182/162
1,371,125 A * 3/1921 Speckman, Jr. ..... E06C 1/3835 182/160
1,500,891 A * 7/1924 Quehl ..... E06C 1/20 182/162
3,084,760 A * 4/1963 Lamberti ..... E06C 1/3835 182/160
4,560,030 A * 12/1985 Mucelli ..... E06C 1/393 182/118
5,158,151 A * 10/1992 Chang ..... E06C 1/18 182/156
5,163,533 A * 11/1992 Lin ..... E06C 1/18 182/159
5,685,394 A * 11/1997 Simson ..... E06C 1/3835 182/159

(Continued)

*Primary Examiner* — Colleen M Chavchavadze

(74) *Attorney, Agent, or Firm* — FisherBroyles, LLP; Rob L. Phillips

(57) ABSTRACT

A collapsible ladder includes a first pair of legs and a second pair of legs, each of the first pair of legs and the second pair of legs is rotatably joined near tops thereof; a plurality of steps extending between one of the first pair of legs and one of the second pair of legs, each of the steps rotatably jointed about a mid-point thereof; a first vertical spar slidably connected to each of the steps near the mid-points thereof; a plurality of supports extending between a second one of the first pair of legs and a second one of the second pair of legs, each of the supports rotatably jointly about a mid-point thereof; and a second vertical spar slidably connected to each of the supports near the mid-points thereof. This configuration allows the ladder to be collapsed by raising the first and second vertical spars causing the steps and supports to fold about their mid-points permitting the first and second pair of legs to be generally folded/collapsed into a single column.

11 Claims, 16 Drawing Sheets

(56) References Cited

U.S. PATENT DOCUMENTS

| | | | | |
|---|---|---|---|---|
| 6,769,515 | B2 * | 8/2004 | Hillebrecht | E06C 1/3835 182/159 |
| 6,802,393 | B2 * | 10/2004 | Zheng | E06C 1/3835 182/157 |
| 6,866,119 | B2 * | 3/2005 | Zheng | E06C 1/32 182/159 |
| 2006/0213721 | A1 * | 9/2006 | Uttaro | E06C 1/32 182/22 |

* cited by examiner

COLLAPSIBLE LADDER

CROSS REFERENCE

This application claims priority to U.S. Patent Application No. 62/807,759 filed Feb. 20, 2019 which is incorporated herein for any and all purposes.

FIELD OF THE INVENTION

The embodiments of the present invention relate to a collapsible, rigid ladder.

BACKGROUND

One common problem with traditional ladders is their large size. With such a large size, ladders are difficult to store and transport. Indeed, the bulkiness of ladders makes them a challenge to lift and move from position to position at a jobsite as needed.

Accordingly, it would be beneficial to develop a new, collapsible ladder that can be reduced in size for ease or storage, transport and movement from position to position at a jobsite.

SUMMARY

The embodiments of the present invention are broadly directed to a ladder comprising a first pair of legs and a second pair of legs, each of said first pair of legs and said second pair of legs rotatably joined near tops thereof; a plurality of steps extending between one of said first pair of legs and one of said second pair of legs, each of said steps rotatably jointed about a mid-point thereof; a first vertical spar slidably connected to each of said steps near said mid-points thereof; a plurality of supports extending between a second one of said first pair of legs and a second one of said second pair of legs, each of said supports rotatably jointed about a mid-point thereof; and a second vertical spar slidably connected to each of said supports near said mid-points thereof. This configuration allows the ladder to be collapsed by raising the first and second vertical spars causing the steps and supports to fold about their mid-points permitting the first and second pair of legs to be generally folded into a single column.

In other embodiments, additional foldable members provide additional support when the ladder is in the open position.

Other variations, embodiments and features of the present invention will become evident from the following detailed description, drawings and claims.

DETAILED DESCRIPTION

Figure 1:
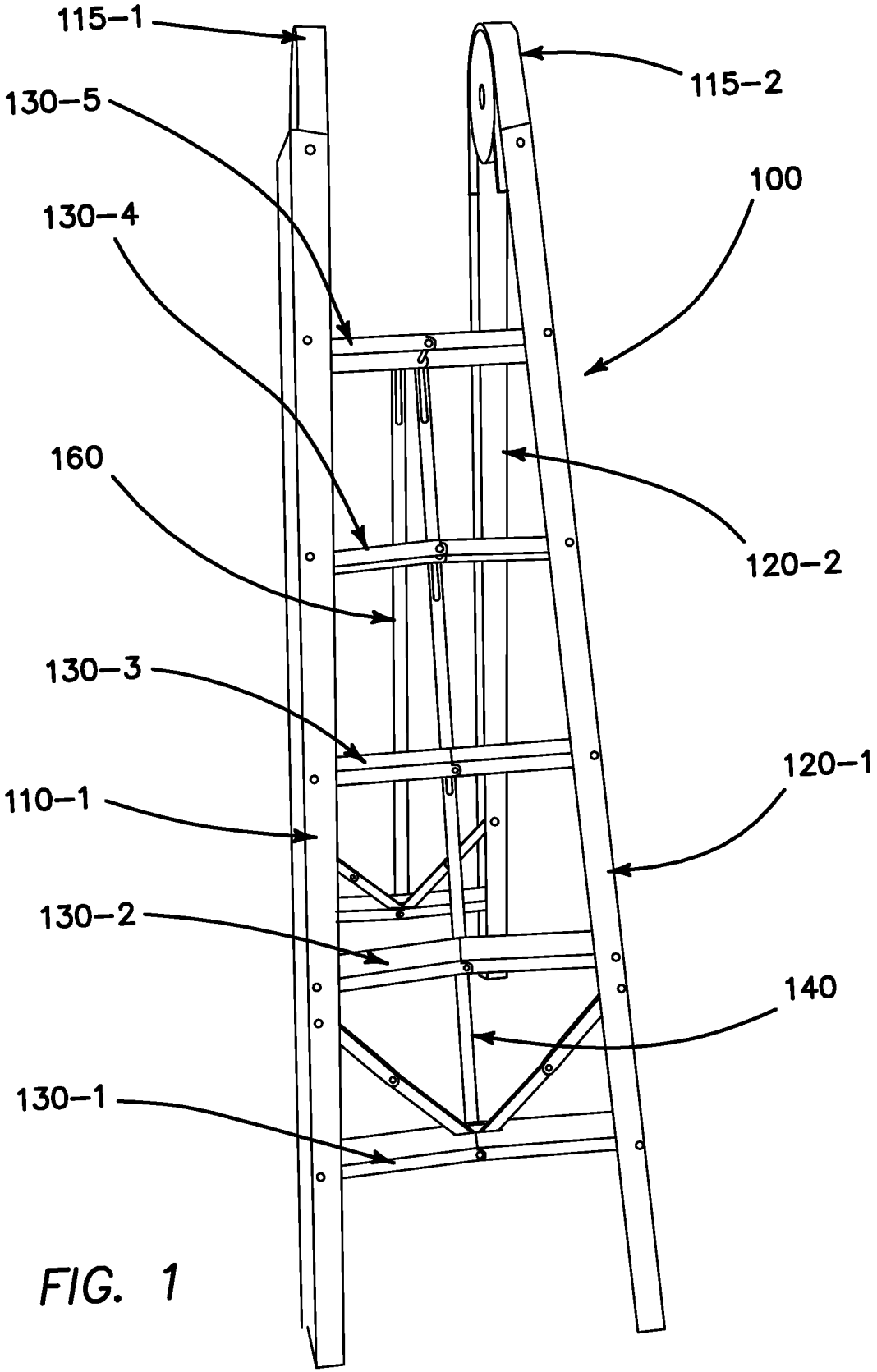
FIG. 1 illustrates a front view of a collapsible ladder in an open position according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 2:
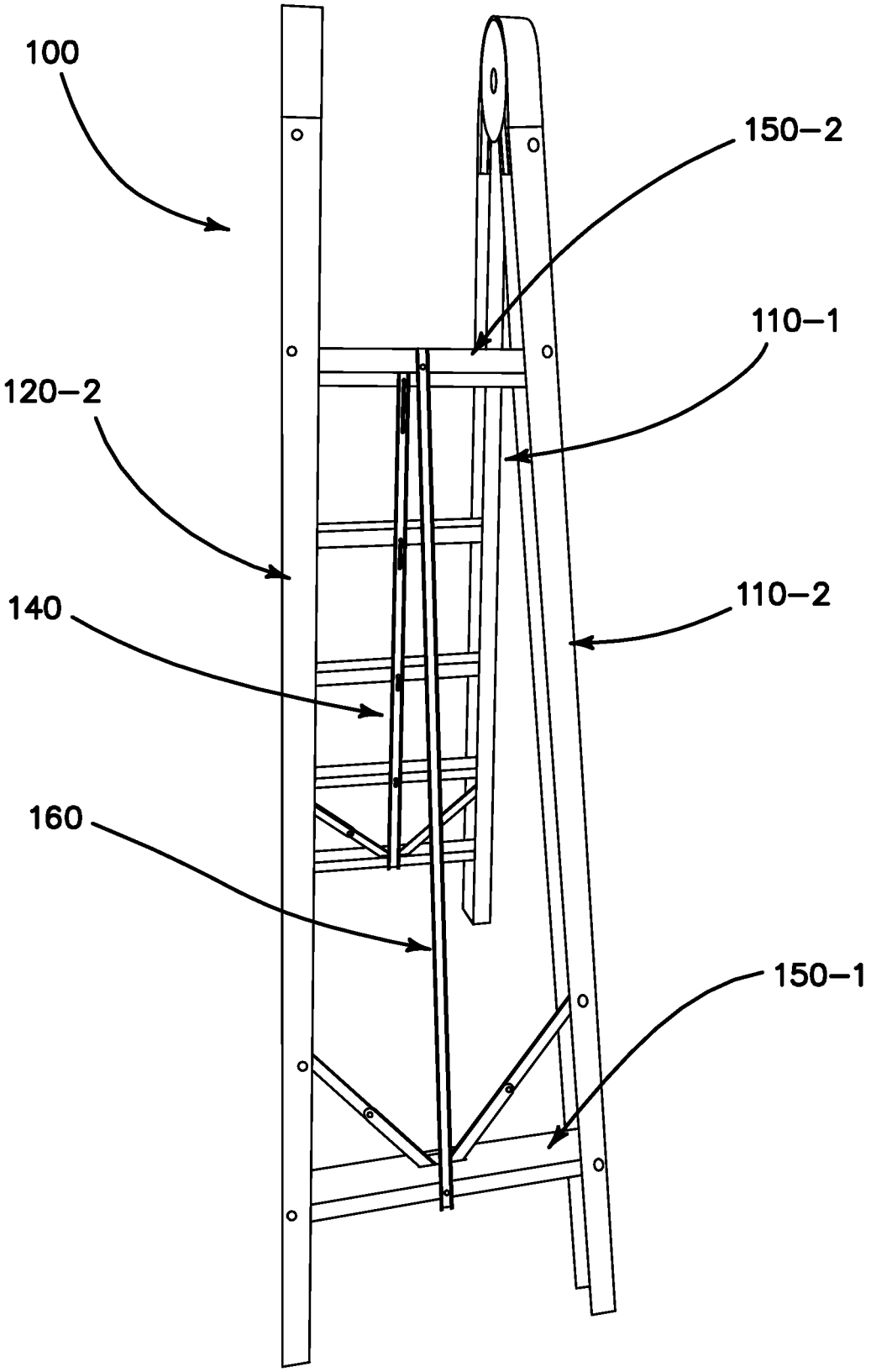
FIG. 2 illustrates a rear view of the collapsible ladder in an open position according to the embodiments of the present invention.
Figure 3:
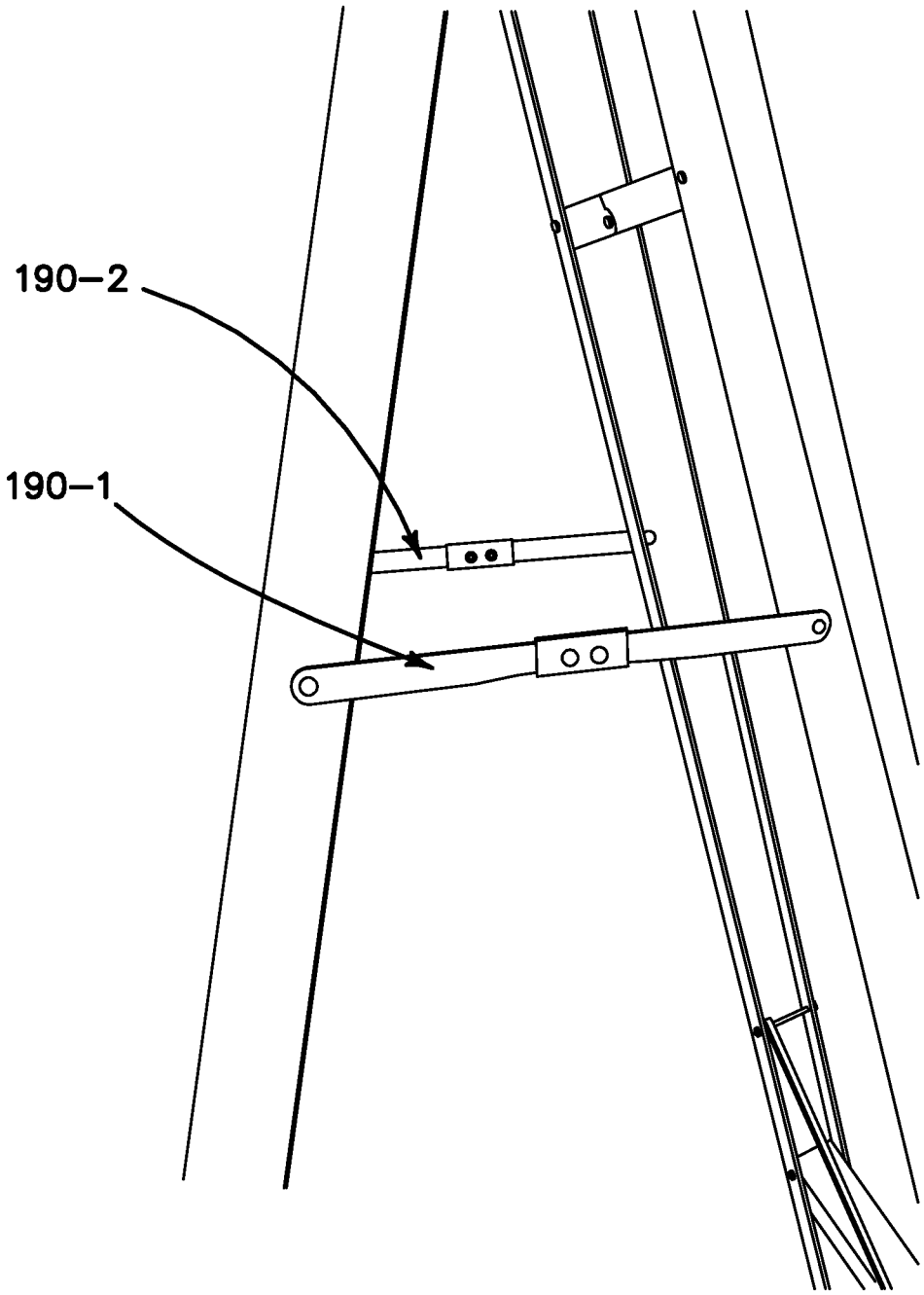
FIG. 3 illustrates a side view of the collapsible ladder in an open position according to the embodiments of the present invention.
Figure 4:
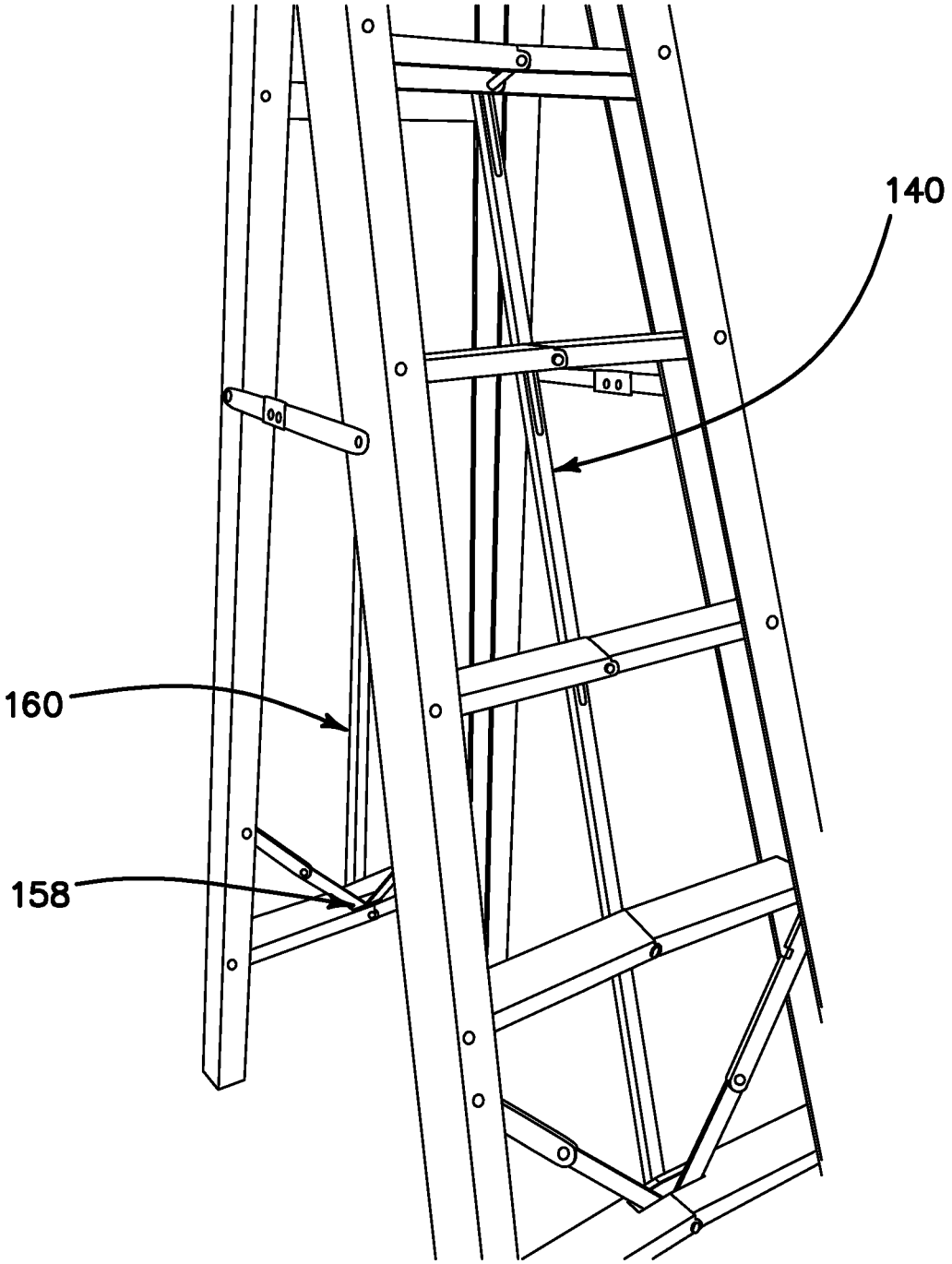
FIG. 4 illustrates a front perspective view of the collapsible ladder in an open position according to the embodiments of the present invention.

FIGS. 1 and 2 show front and rear views, respectively, of a ladder 100 according to the embodiments of the present invention. The ladder 100 broadly comprises a first pair of legs 110-1, 110-2 and a second pair of legs 120-1, 120-2. The first pair of legs 110-1, 110-2 and the second pair of legs 120-1, 120-2 are rotatably joined to one another at tops thereof via connectors 115-1, 115-2. The connectors 115-1, 115-2 provide means for the first pair of legs 110-1, 110-2 and second pair of legs 120-1, 120-2 to open into a useable position forming the well-known A-shaped ladder. As shown in FIGS. 3 and 4, in one embodiment, the legs 110-1, 110-2, 120-1, 120-2 have U-shaped cross-sections.

Figure 12:
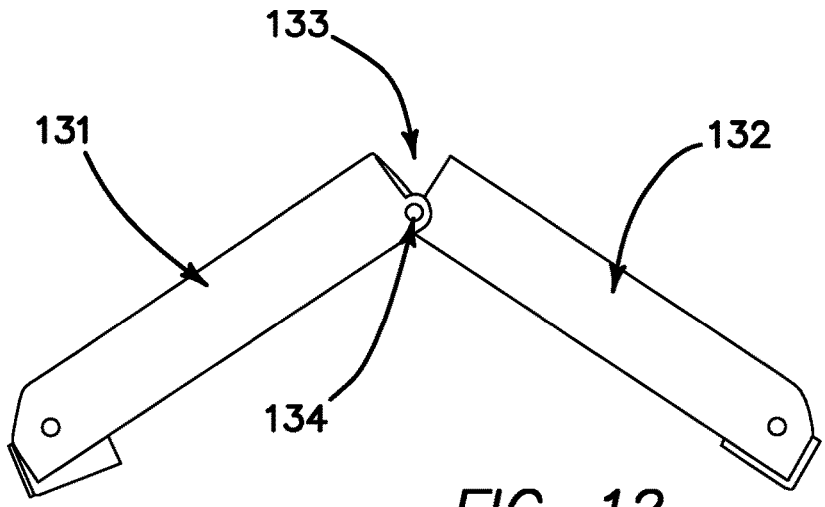
FIG. 12 illustrates a front view of a step of the collapsible ladder in a partially collapsed position according to the embodiments of the present invention.
Figure 13:
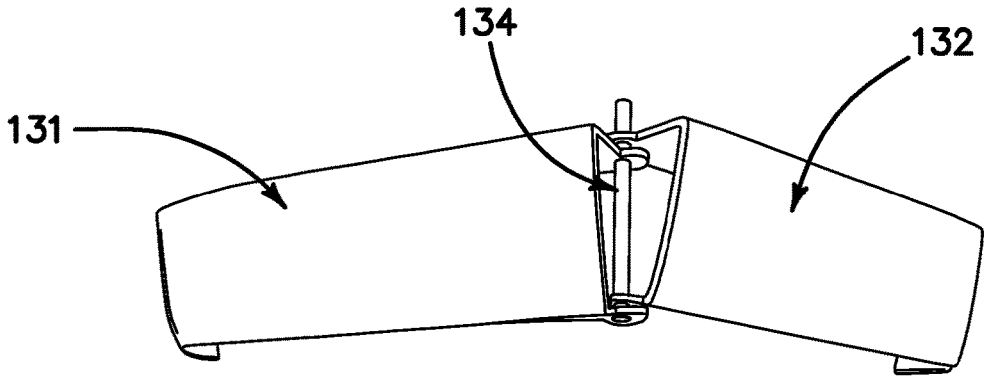
FIG. 13 illustrates a top down view of the step of the collapsible ladder in a partially collapsed position according to the embodiments of the present invention.
Figure 14:
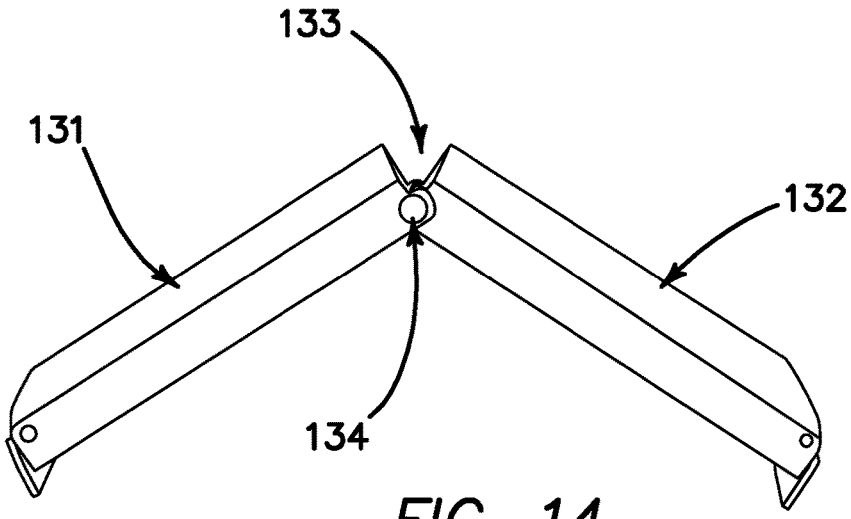
FIG. 14 illustrates an underside view of the step of the collapsible ladder in a partially collapsed position according to the embodiments of the present invention.

As shown in FIGS. 1-7, steps 130-1 through 130-5 extend between legs 110-1 and 120-1. Each step 130-1 through 130-5 is rotatably connected at a first end to leg 110-1 and a second end to leg 120-1. Any number of fasteners, including rivets, nuts and bolts, pins and cotter pins, etc., may be used to rotatably attach the ends of the steps 130-1 through 130-5 to the legs 110-1, 120-2. As shown best in FIGS. 12-14, each step 130-1 through 130-5 is formed of a first segment 131 and second segment 132. In one embodiment, each segment 131, 132 has a U-shaped cross-section but those skilled in the art will recognize that other cross-sections are conceivable.

Each step segment 131 is rotatably connected to a neighboring step segment 132 forming a step rotatably jointed near its mid-point. Like the connections of the steps 130-1 through 130-5 to the legs, any number of fasteners, including rivets, nuts and bolts, pins and cotter pins, etc., may be used to rotatably connect the first step segment 131 to the second step segment 132. Having a first end and second end of each step 130-1 through 130-5 (also being the far ends of the first segment 131 and second segment 132) connected to an opposite leg, and the first segment 131 and second segment 132 rotatably connected to one another creates a step foldable onto itself about the mid-point 133. With the U-shaped cross section, either the first segment 131 or second segment 132 is slightly offset or tilted to permit the first segment 131 and second segment 132 to fold together such that the two sides of the U-shaped cross-sections mate side-by-side when any step 130-1 through 130-5 is folded about the mid-point 133. If the first segment 131 and second segment 132 were aligned exactly the sides of the U-shaped cross-sections would interfere with one another when the first segment 131 and second segment 132 were folded onto one another about the mid-point 133.

Spar 140 includes slots 145 which receives the end of the bolt 134 allowing a nut or similar article to slidably secure the spar 140 to the step 130. This same arrangement may be used for slidably connecting the spar 140 to each step 130-1 through 130-5. In one embodiment, spar 140 is connected to inner surfaces of the steps 130-1 through 130-5 to avoid interfering with a person climbing the steps 130-1 through 130-5.

Figure 5:
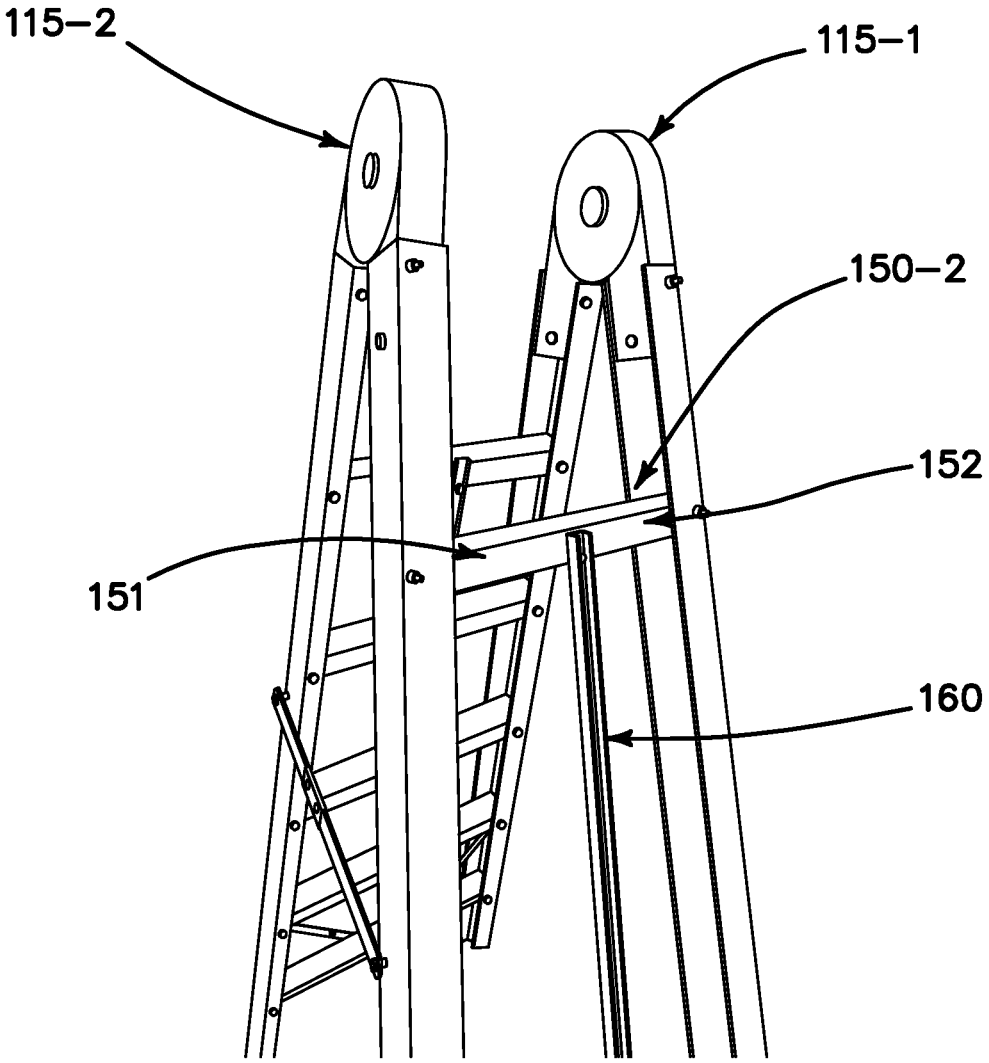
FIG. 5 illustrates a rear perspective view of the collapsible ladder in an open position according to the embodiments of the present invention.
Figure 6:
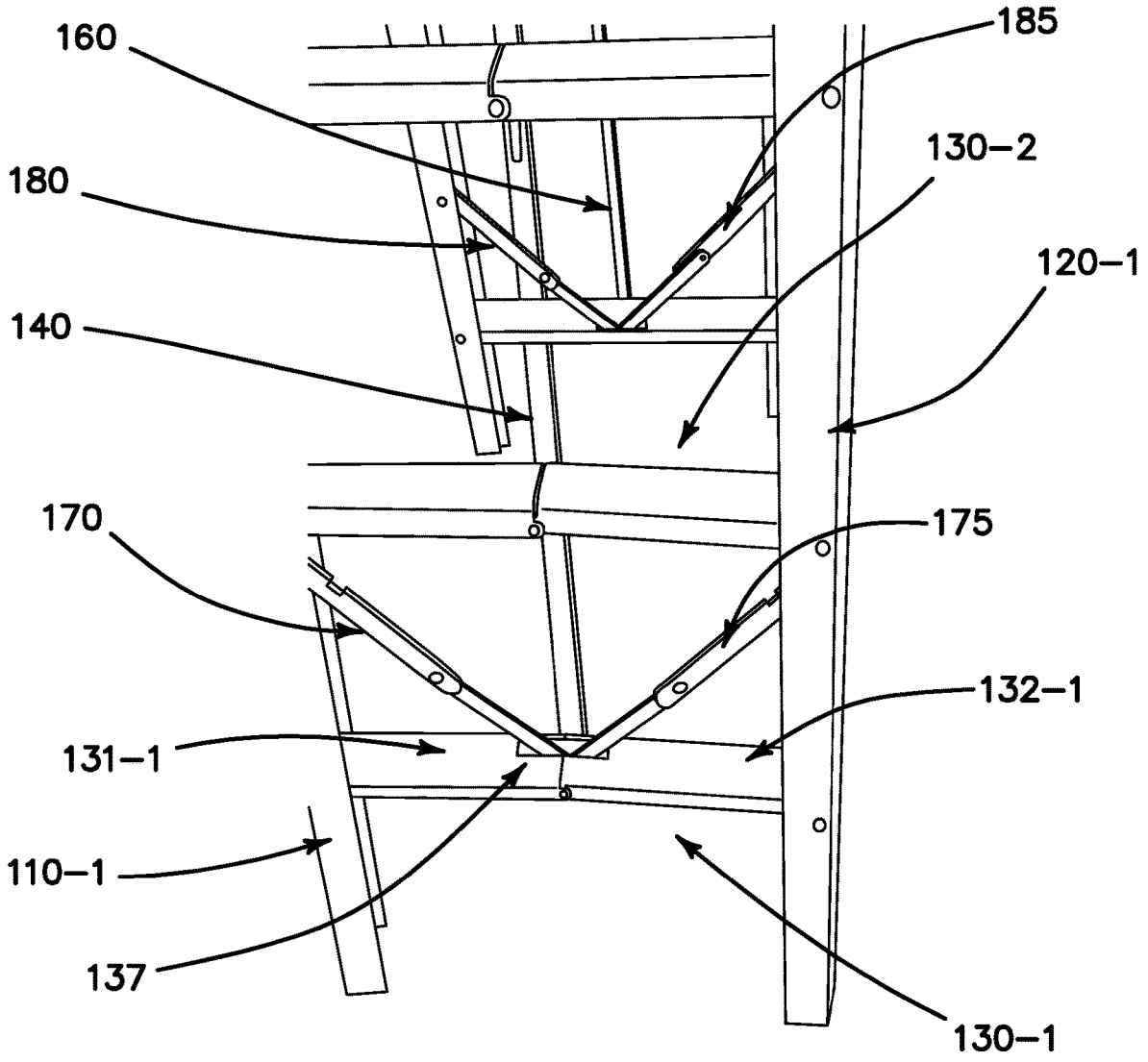
FIG. 6 illustrates a front close-up view of the collapsible ladder in an open position according to the embodiments of the present invention.
Figure 7:
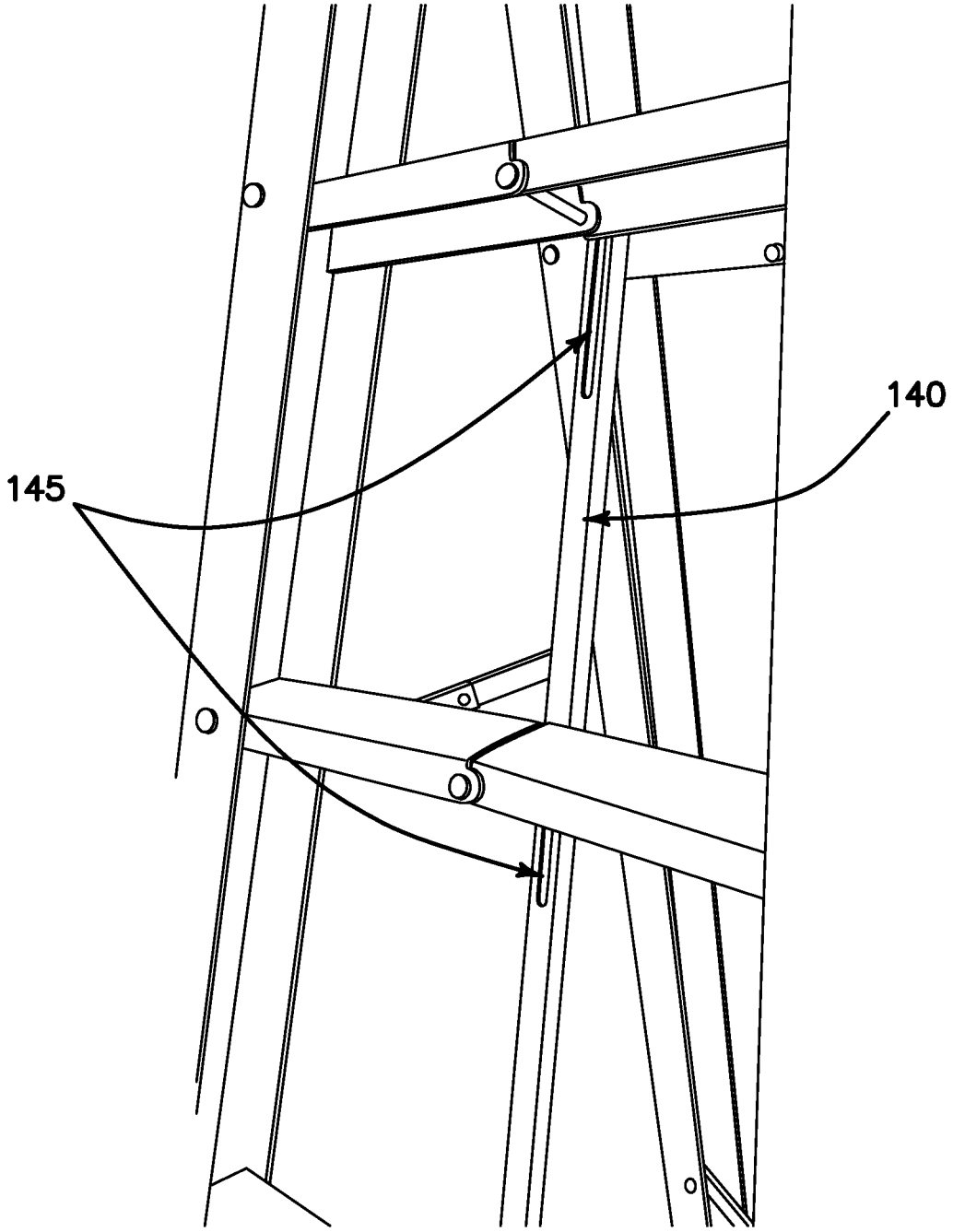
FIG. 7 illustrates a front perspective close-up view of the collapsible ladder in an open position according to the embodiments of the present invention.

As shown in FIGS. 2 and 5, supports 150-1 and 150-2 extend between legs 110-2 and 120-2. Each support 150-1, 150-2 is rotatably connected at a first end to leg 110-2 and a second end to leg 120-2. Any number of fasteners, including rivets, nuts and bolts, pins and cotter pins, etc., may be used to rotatably attach the ends of the supports 150-1, 150-2 to the legs 110-2, 120-2. In one embodiment, like steps 130-1 through 130-5, each support is formed of a first segment 151 and second segment 152 and have U-shaped cross-sections.

Each support segment 151 is rotatably connected to a neighboring support segment 152 forming a support jointed about its mid-point. Like the connections of the steps 130-1 through 130-5 to the legs, any number of fasteners, including rivets, nuts and bolts, pins and cotter pins, etc., may be used to rotatably attach support segment 151 to support segment 152. Having a first end and second end of each support 150-1, 150-2 (also being the far ends of support segment 151 and support segment 152) connected to an opposite leg, and the support segment 151 and support segment 152 rotatably connected to one another creates a support foldable onto itself about the mid-point 153. The supports 150-1, 150-2 have a similar U-shaped cross-sectional and offset design as the steps 130-1 through 130-5.

Like spar 140 relative to the steps 130-1 through 130-5, spar 160 serves the same purpose relative to the supports 150-1, 150-2. The spar 160 includes slots 165 which receives the end of a bolt 154 allowing a nut or similar article to slidably secure the spar 160 to the supports 150-1, 150-2. Spar 160 is connected to outer surfaces of the supports 150-1, 150-2.

A first locking slat member 170 extends angularly between leg 110-1 and step 130-1 while a second locking slat member 175 extends angularly between leg 120-1 and step 130-1. The first locking slat member 170 and second locking slat member 175 both connect to bolt 134 (or other fastener), via slot 137, being used to rotatably connect the first segment 131 and second segment 131 of step 130-1 to one another. The locking slats 170, 175 are each lockable about their mid-points.

A third locking slat member 180 extends angularly between leg 110-2 and support 150-1 while a fourth locking slat member 185 extends angularly between leg 120-2 and support 150-1. The third locking slat member 180 and fourth locking slat member 185 both connect to a bolt (or other fastener), via slot 158, being used to rotatably connect the first segment 151 and second segment 152 of support 150-1 to one another. The locking slats 180, 185 are each lockable about their mid-points.

A pair of horizontal locking slats 190-1, 190-2 extend between legs 110-1 and 110-2 and legs 120-1 and 120-2, respectively. The pair of horizontal locking slats 190-1, 190-2 maintain the legs 110-1, 110-2 and legs 120-1, 120-2 in an open position, respectively.

Figure 8:
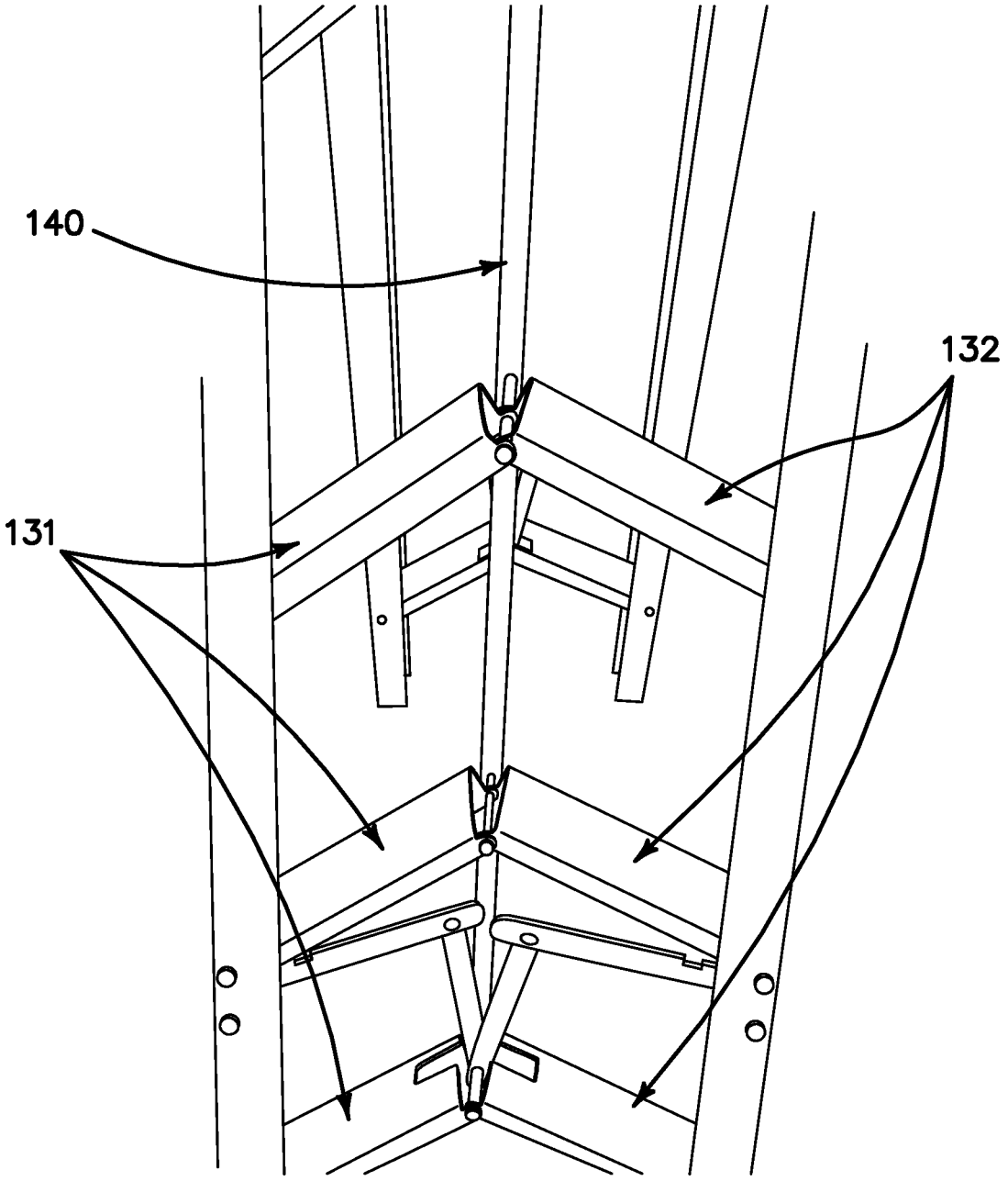
FIG. 8 illustrates a front close-up view of the collapsible ladder in a partially collapsed position according to the embodiments of the present invention.
Figure 9:
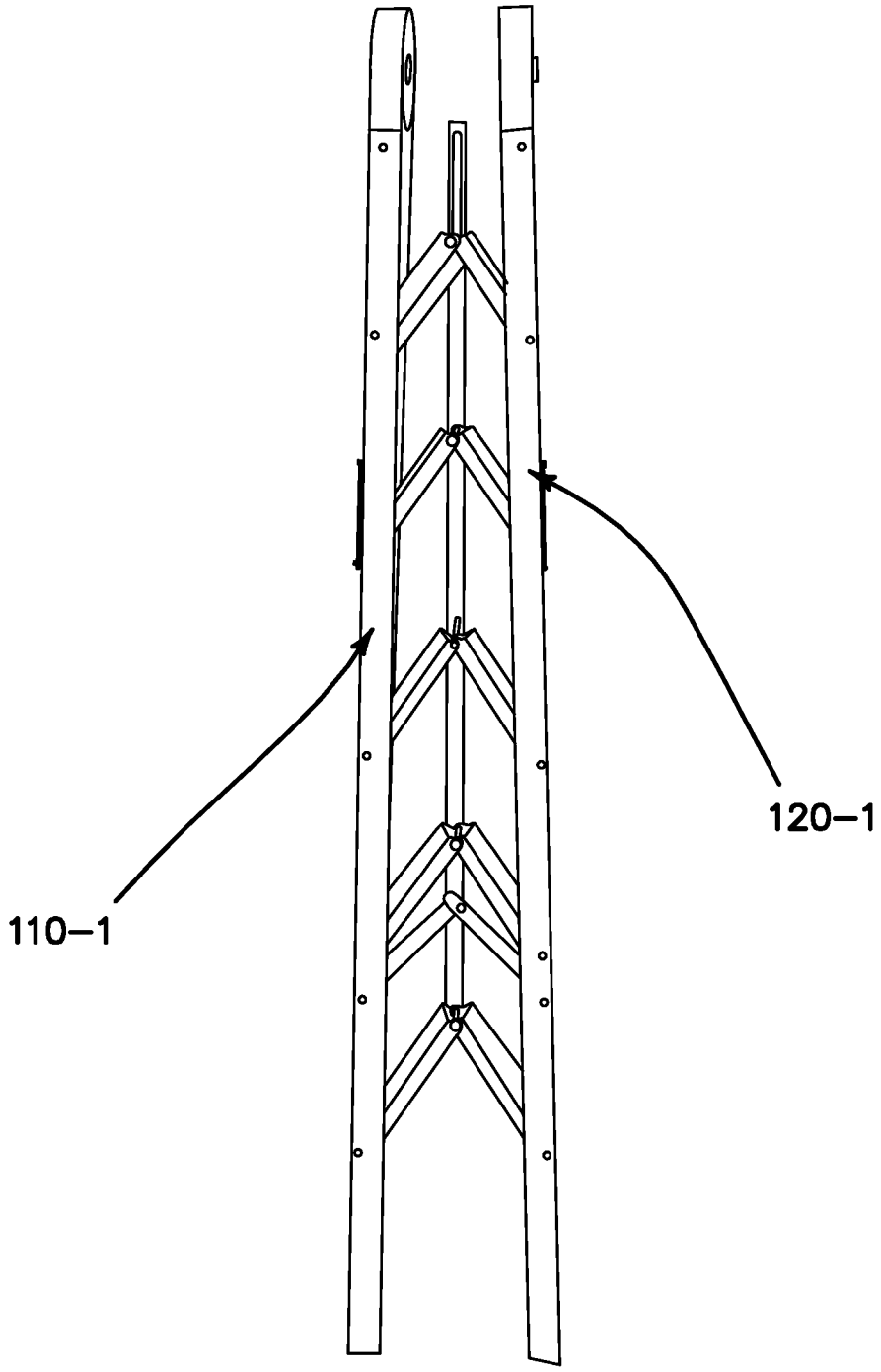
FIG. 9 illustrates a front view of the collapsible ladder in a partially collapsed position according to the embodiments of the present invention.
Figure 10:
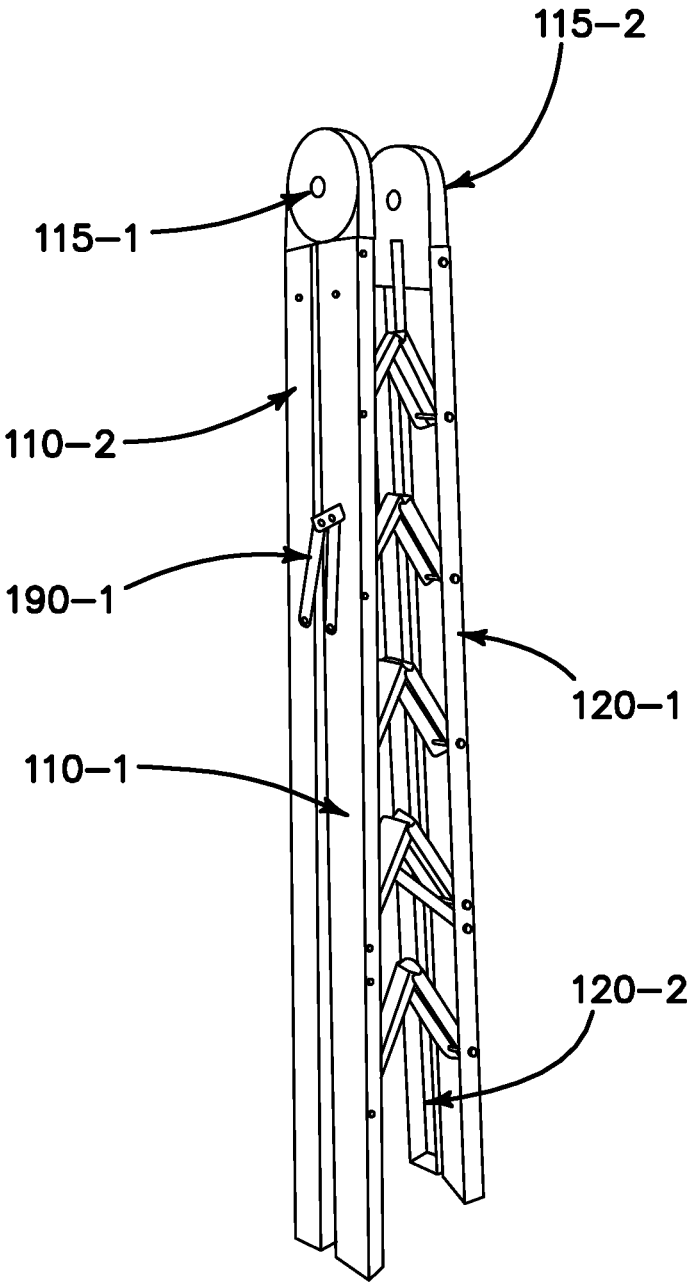
FIG. 10 illustrates a front perspective view of the collapsible ladder in a partially collapsed position according to the embodiments of the present invention.
Figure 11:
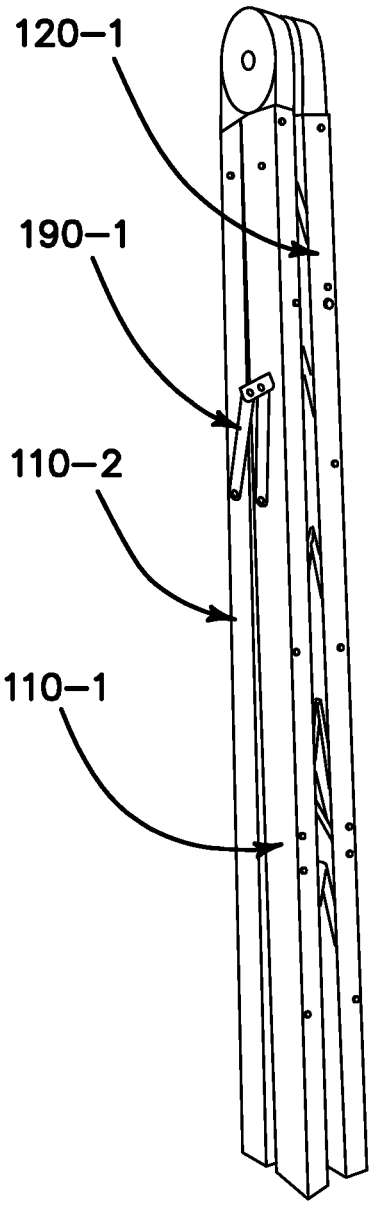
FIG. 11 illustrates a side view of the collapsible ladder in a fully collapsed position according to the embodiments of the present invention.
Figure 15:
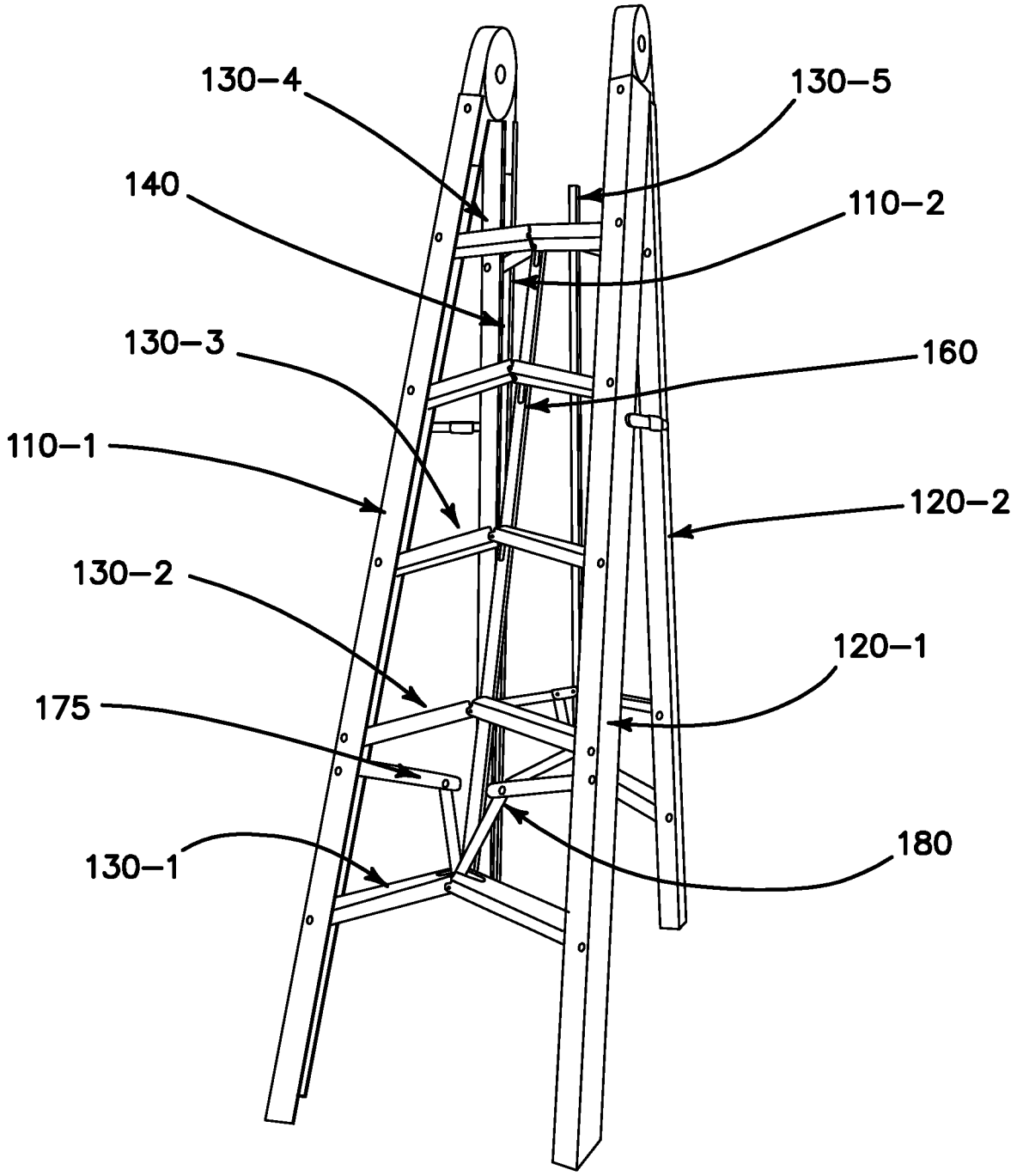
FIG. 15 illustrates a first view of a vertical slat being utilized to collapse the ladder according to the embodiments of the present invention.
Figure 16:
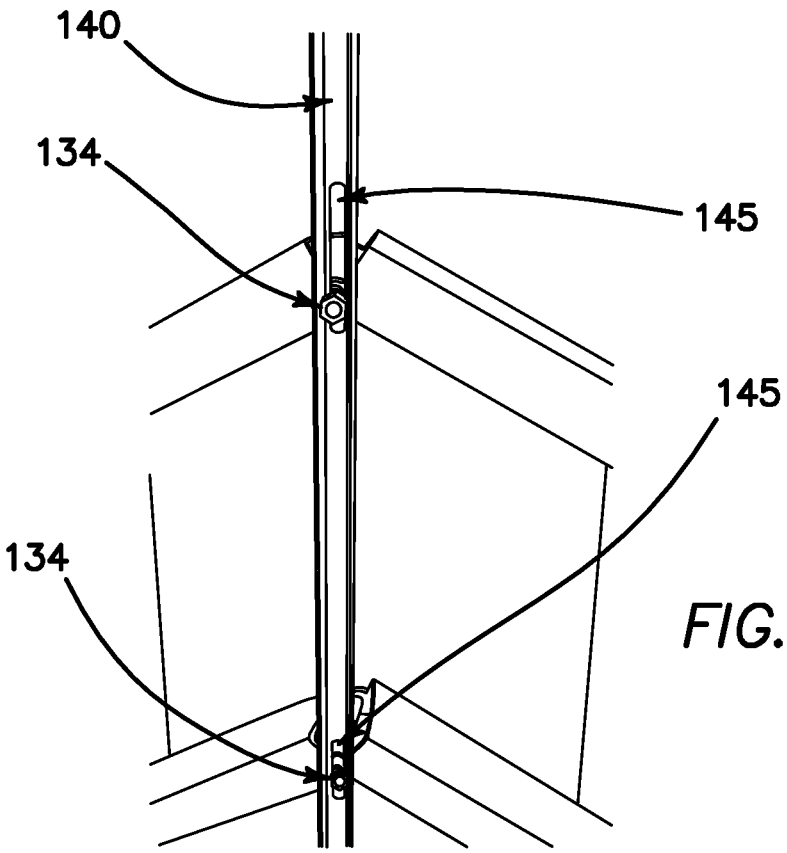
FIG. 16 illustrates a second view of the vertical slat being utilized to collapse the ladder according to the embodiments of the present invention.
Figure 17:
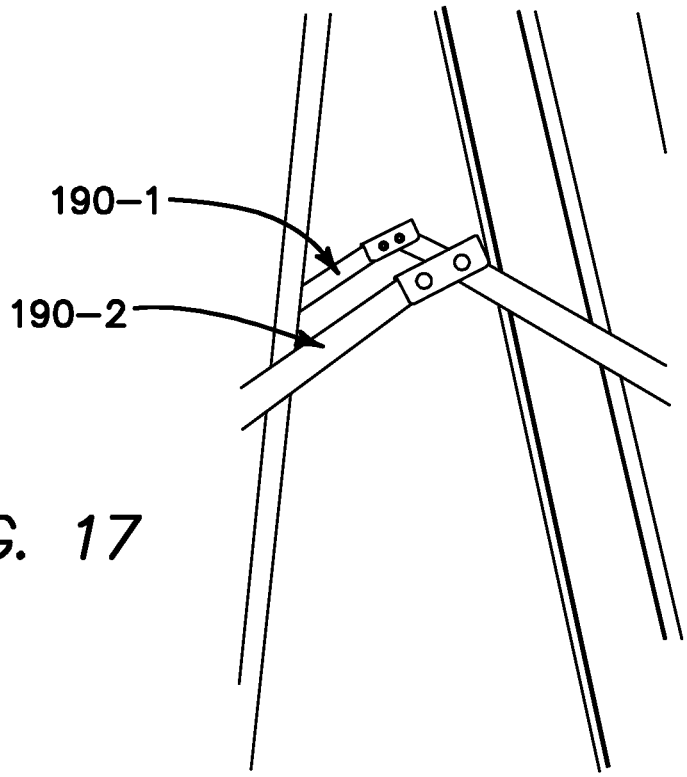
FIG. 17 illustrates horizontal slats being unlocked to collapse the ladder according to the embodiments of the present invention.
Figure 18:
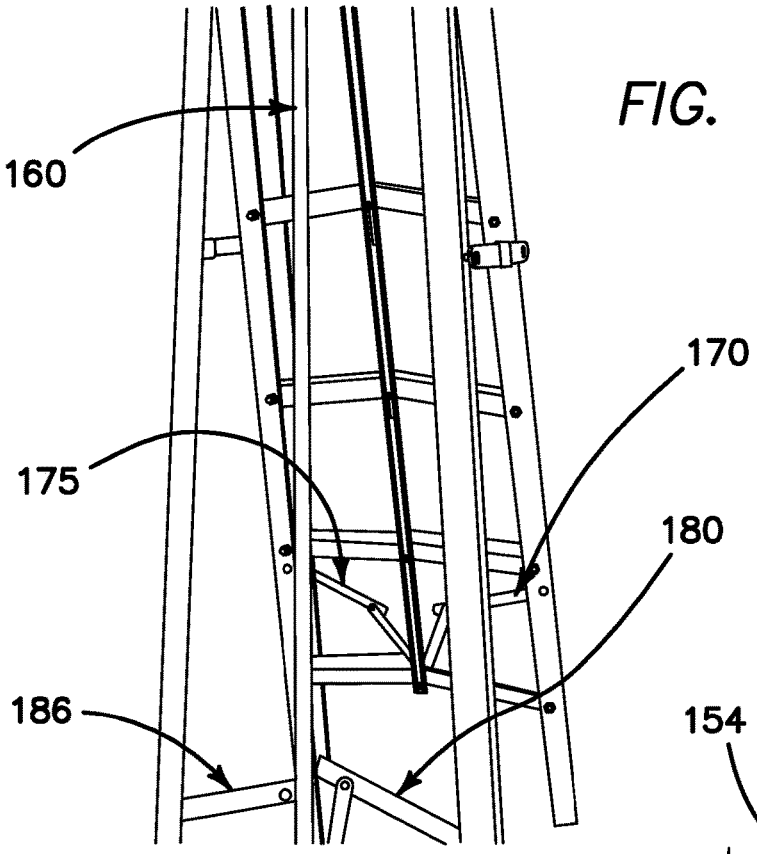
FIG. 18 illustrates angled slats being unlocked to collapse the ladder according to the embodiments of the present invention.
Figure 19:
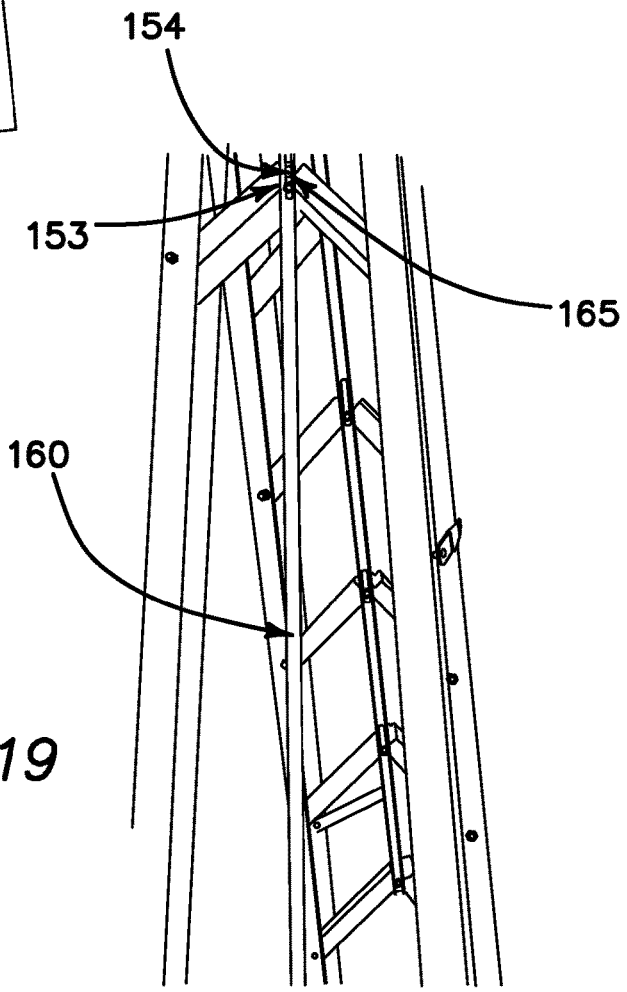
FIG. 19 illustrates a first rear view of the ladder in a partially collapsed position according to the embodiments of the present invention.
Figure 20:
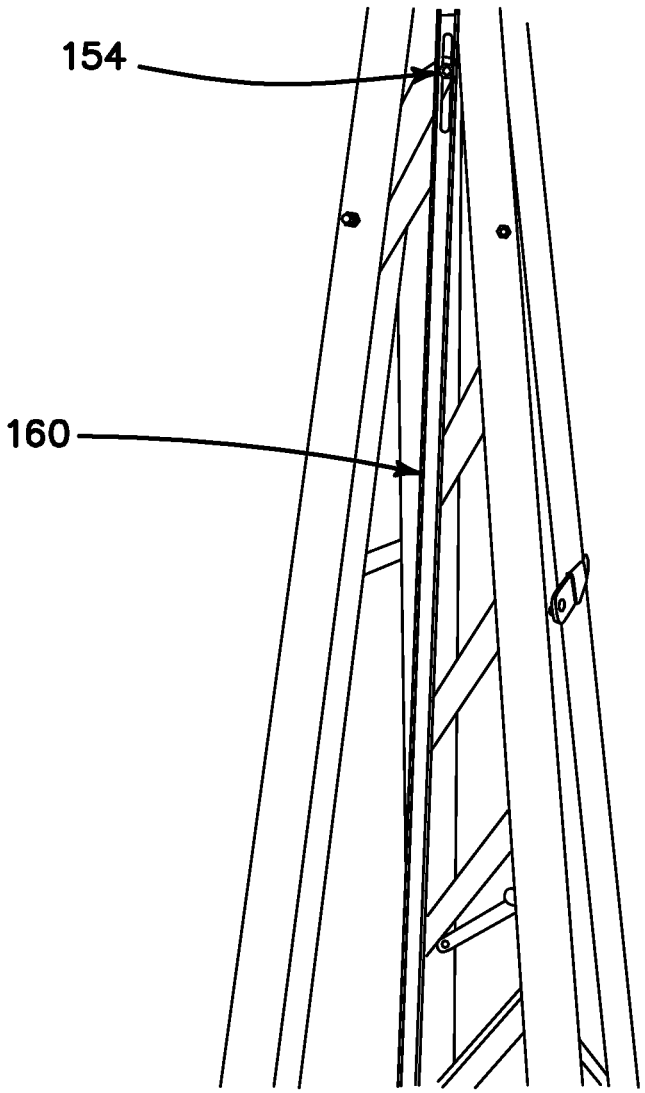
FIG. 20 illustrates a second rear view of the ladder in a more collapsed position according to the embodiments of the present invention.
Figure 21:
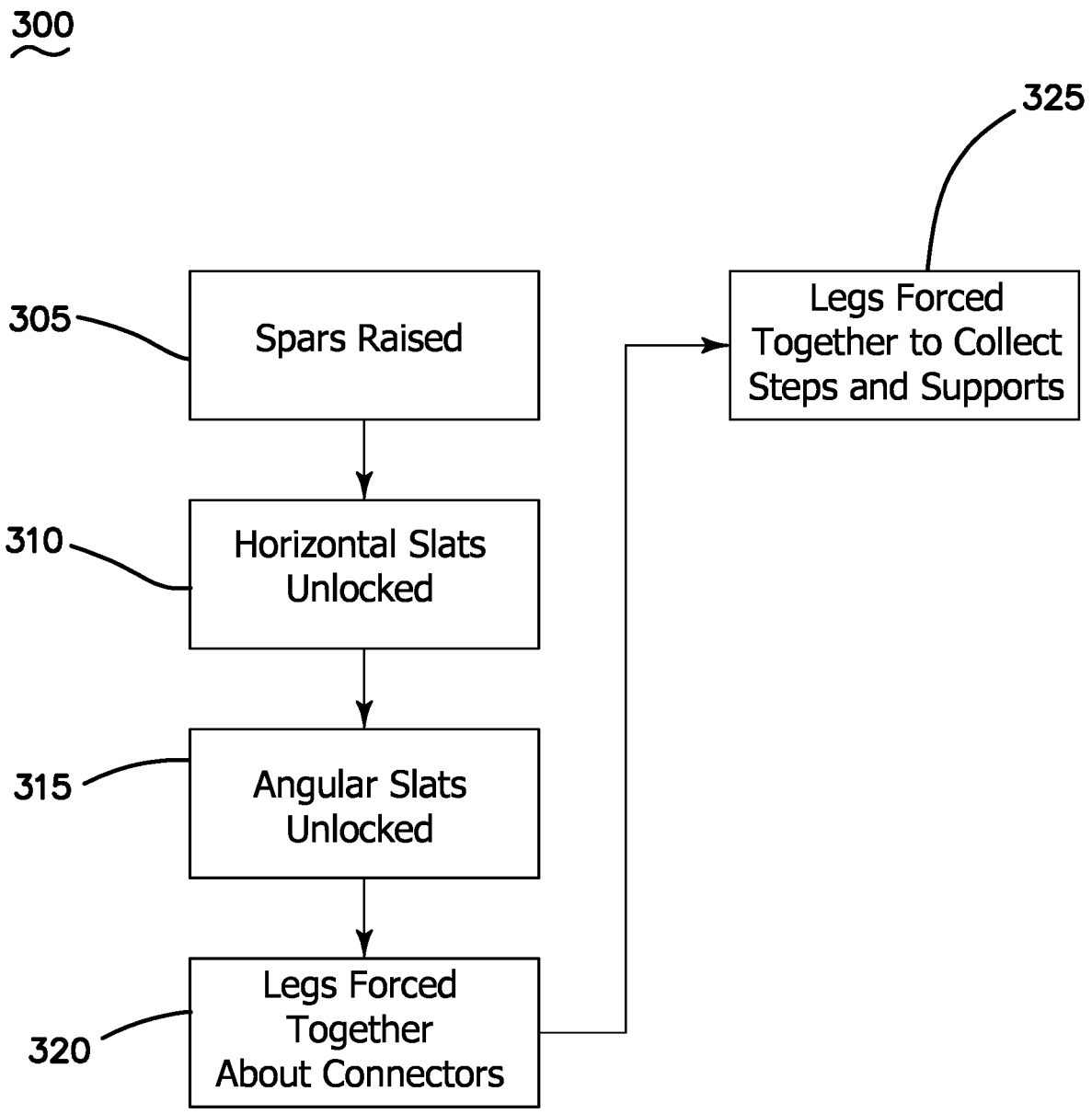
FIG. 21 illustrates a flow chart detailing the process for collapsing the ladder according to the embodiments of the present invention.

FIGS. 8-11 and 15-21 show the process for expanding and collapsing the ladder 100 according to flow chart 300 shown in FIG. 21. Assuming the ladder 100 is in an open position, at step 305, spars 140, 160 are raised causing steps 130-1 through 130-2 and supports 150-1, 150-2 to fold upward about respective mid-points 133, 151 as best shown in FIGS. 8 and 16. By raising the spars 140, 160, the slots 145, 165 are able to slide upwards along the bolts 134, 154 also serving to rotatably connect the steps 130-1 through 130-5 and supports 1501, 150-2. At step 310, the pair of horizontal locking slats 190-1, 190-2 are unlocked as best shown in FIG. 17. At step 315, the first locking slat member 170, second locking slat member 175, third locking slat member 180 and fourth locking slat member 185 are unlocked as best shown in FIGS. 8 and 15. With each of the slats unlocked, at step 320, legs 110-1, 110-2 and legs 120-1, 120-2 may be forced together about connectors 115-1, 115-2 as best shown in FIGS. 9 and 10. At step 325, legs 110-1, 120-2 and legs 110-2, 120-2 are forced together to collect within the U-shaped cross-sections thereof the completely folded steps 130-1 through 130-5 and supports 150-1, 150-2 as best shown in FIG. 11. While flow chart 300 shows a specific order of steps, those skilled in the art will recognize that the steps may re-ordered and still achieve the objection of collapsing the ladder. From a collapsed state, the ladder may be opened by using the same general steps in reverse order.

As shown in FIG. 11, the fully collapsed ladder 100 has a total cross-section substantially equivalent to the aggregate cross-sections of the four legs 110-1, 110-2, 120-1, 120-2. Such a small profile allows for easy storage, transport and movement from position to position at a jobsite.

Although the invention has been described in detail with reference to several embodiments, additional variations and modifications exist within the scope and spirit of the invention.

I claim:

1. A collapsible ladder comprising:

a first pair of legs and a second pair of legs, each of said first pair of legs and said second pair of legs rotatably joined near tops thereof;

a plurality of steps, each comprising two step segments extending between one of said first pair of legs and one of said second pair of legs, said two step segments each having a U-shaped cross section and rotatably connected at ends thereof about a mid-point of each of said steps, said two step segments offset or tilted about said mid-point allowing said two step segments to mate side-by-side when said steps are folded about said mid-point;

a first vertical spar slidably connected to each of said steps near said mid-points thereof and inner edges thereof;

a plurality of supports, each comprising two support segments extending between a second one of said first pair of legs and a second one of said second pair of legs, said two support segments each having a U-shaped cross section comprising an upper step portion and two side portions extending downward along a length of said upper step portion, said two support segments rotatably connected at ends thereof about a mid-point of each of said supports, said two side portions of each of said support segments offset or tilted about said mid-point allowing said two side portions of each of said support segments to mate side-by-side when said supports are folded about said mid-point;

a second vertical spar slidably connected to each of said supports near said mid-points thereof; and a first angled slat extending downward between a first one of said first pair of legs and a bottommost step and a second angled slat extending downward between a first one of said second pair of legs and said bottommost step, one end of said first angled slat and said second angled slat passing through an upper surface of said bottommost step and connecting to a fastener rotatably joining said two step segments forming said bottommost step.

2. The collapsible ladder of claim 1 further comprising a first horizontal slat extending between said first pair of legs and a second horizontal slat extending between said second pair of legs.

3. The collapsible ladder of claim 1 further comprising a first angled slat extending between a second one of said first pair of legs and one of said plurality of supports and a second angled slat extending between a second one of said second pair of legs and said one of said plurality of supports.

4. The collapsible ladder of claim 1 wherein said steps and supports are rotatably connected to said legs.

5. A collapsible ladder comprising:

a first pair of legs and a second pair of legs, each of said first pair of legs and said second pair of legs rotatably joined near tops thereof;

a plurality of steps, each comprising two step segments extending between one of said first pair of legs and one of said second pair of legs, said two step segments each having a U-shaped cross section and rotatably connected at ends thereof about a mid-point of each of said steps, said two step segments offset or tilted about said mid-point allowing said two step segments to mate side-by-side when said steps are folded about said mid-point;

a first vertical spar slidably connected to each of said steps near said mid-points thereof and inner edges thereof;

a plurality of supports, each comprising two support segments extending between a second one of said first pair of legs and a second one of said second pair of legs, said two support segments each having a U-shaped cross section comprising an upper step portion and two side portions extending downward along a length of said upper step portion, said two support segments rotatably connected at ends thereof about a mid-point of each of said supports, said two side portions of said of said support segments offset or tilted about said mid-point allowing said two side portions of each of said support segments to mate side-by-side when said supports are folded about said mid-point;

a second vertical spar slidably connected to each of said steps near said mid-points thereof;

a first angled slat extending downward between a first one of said first pair of legs and a bottommost step and a second angled slat extending downward between a first one of said second pair of legs and said bottommost step, one end of said first angled slat and said second angled slat passing through an upper surface of said bottommost step and connecting to a fastener rotatably joining said two step segments forming said bottommost step; and wherein said first pair of legs and said second pair of legs have U-shaped cross-sections dimensioned to contain said plurality of steps and said plurality of supports when said ladder is in a collapsed state.

6. The collapsible ladder of claim 5 further comprising a first horizontal slat extending between said first pair of legs and a second horizontal slat extending between said second pair of legs.

7. The collapsible ladder of claim 5 further comprising a first angled slat extending between a second one of said first pair of legs and one of said plurality of supports and a second angled slat extending between a second one of said second pair of legs and said one of said plurality of supports.

8. The collapsible ladder of claim 5 wherein said steps and supports are rotatably connected to said legs.

9. A collapsible ladder comprising:

a first pair of legs and a second pair of legs, each of said first pair of legs and said second pair of legs rotatably joined near tops thereof;

a plurality of steps extending between one of said first pair of legs and one of said second pair of legs, each of said plurality of said steps formed of two separate segments rotatably connected to one another, said two separate step segments each having a U-shaped cross section, said two step segments offset or tilted about said rotatable connection allowing said two step segments to mate side-by-side when said steps are folded about said rotatable connection;

a first vertical spar slidably connected to each of said steps at inner edges thereof and configured to fold said plurality of said steps;

a plurality of supports extending between a second one of said first pair of legs and a second one of said second pair of legs, each of said plurality of said supports formed of two separate segments rotatably connected to one another, said two separate support segments each having a U-shaped cross section comprising an upper step portion and two side portions extending downward along a length of said upper step portion, said two side portions of said separate support segments offset or tilted about said rotatable connection allowing said two side portions of said support segments to mate side-by-side when said supports are folded about said rotatable connection;

a second vertical spar slidably connected to each of said steps and configured to fold said plurality of said supports; and a first angled slat extending downward between a first one of said first pair of legs and a bottommost step and a second angled slat extending downward between a first one of said second pair of legs and said bottommost step, one end of said first angled slat and said second angled slat passing through an upper surface of said bottommost step and connecting to a fastener rotatably joining said two step segments forming said bottommost step.

10. The collapsible ladder of claim 9 further comprising a first horizontal slat extending between said first pair of legs and a second horizontal slat extending between said second pair of legs.

11. The collapsible ladder of claim 9 further comprising a first angled slat extending between a second one of said first pair of legs and one of said plurality of supports and a second angled slat extending between a second one of said second pair of legs and said one of said plurality of supports.

* * * * *